US009164445B2

(12) United States Patent
Shimokawa et al.

(10) Patent No.: US 9,164,445 B2
(45) Date of Patent: Oct. 20, 2015

(54) FIXING DEVICE AND IMAGE FORMING APPARATUS

(71) Applicants: Toshihiko Shimokawa, Kanagawa (JP); Yutaka Ikebuchi, Kanagawa (JP); Ryuuichi Mimbu, Kanagawa (JP); Shuutaroh Yuasa, Kanagawa (JP)

(72) Inventors: Toshihiko Shimokawa, Kanagawa (JP); Yutaka Ikebuchi, Kanagawa (JP); Ryuuichi Mimbu, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/497,491

(22) Filed: Sep. 26, 2014

(65) Prior Publication Data

US 2015/0104227 A1 Apr. 16, 2015

(30) Foreign Application Priority Data

Oct. 10, 2013 (JP) ..... 2013-212840

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2089; G03G 2215/2025; G03G 2215/2029; G03G 15/2053
USPC ..... 399/329
See application file for complete search history.

(56) References Cited

U.S. PATENT DOCUMENTS

| | | | |
|---|---|---|---|
| 2011/0044734 | A1 | 2/2011 | Shimokawa et al. |
| 2011/0085832 | A1 | 4/2011 | Hasegawa et al. |
| 2011/0116848 | A1 | 5/2011 | Yamaguchi et al. |
| 2011/0211876 | A1 | 9/2011 | Iwaya et al. |
| 2011/0229181 | A1 | 9/2011 | Iwaya et al. |
| 2012/0121303 | A1 | 5/2012 | Takagi et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2013/0045032 | A1 | 2/2013 | Shimokawa et al. |
| 2013/0164056 | A1 | 6/2013 | Imada et al. |
| 2013/0209146 | A1 | 8/2013 | Yamaji et al. |

FOREIGN PATENT DOCUMENTS

| | | |
|---|---|---|
| JP | 2013-041129 | 2/2013 |
| JP | 2013-134306 | 7/2013 |
| JP | 2013-182110 | 9/2013 |

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A fixing device includes an endless belt rotatable in a predetermined direction of rotation and an opposed rotator contacting an outer circumferential surface of the endless belt. A nip formation pad, disposed opposite an inner circumferential surface of the endless belt, presses against the opposed rotator via the endless belt to form a fixing nip between the endless belt and the opposed rotator, through which a recording medium is conveyed. A belt holder contacts and rotatably supports a lateral end of the endless belt in an axial direction thereof. A ring is interposed between the belt holder and a lateral edge face of the endless belt. A restraint disposed opposite the ring contacts the ring to restrict movement of the ring in a radial direction of the endless belt within a trajectory of the lateral end of the rotating endless belt.

20 Claims, 13 Drawing Sheets

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-212840, filed on Oct. 10, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes an endless belt rotatable in a predetermined direction of rotation and an opposed rotator contacting an outer circumferential surface of the endless belt. A nip formation pad, disposed opposite an inner circumferential surface of the endless belt, presses against the opposed rotator via the endless belt to form a fixing nip between the endless belt and the opposed rotator, through which a recording medium is conveyed. A belt holder contacts and rotatably supports a lateral end of the endless belt in an axial direction thereof. A ring is interposed between the belt holder and a lateral edge face of the endless belt. A restraint disposed opposite the ring contacts the ring to restrict movement of the ring in a radial direction of the endless belt within a trajectory of the lateral end of the rotating endless belt.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes an endless belt rotatable in a predetermined direction of rotation and an opposed rotator contacting an outer circumferential surface of the endless belt. A nip formation pad, disposed opposite an inner circumferential surface of the endless belt, presses against the opposed rotator via the endless belt to form a fixing nip between the endless belt and the opposed rotator, through which a recording medium is conveyed. A belt holder contacts and rotatably supports a lateral end of the endless belt in an axial direction thereof. A ring is interposed between the belt holder and a lateral edge face of the endless belt. A restraint disposed opposite the ring contacts the ring to restrict movement of the ring in a radial direction of the endless belt within a trajectory of the lateral end of the rotating endless belt.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
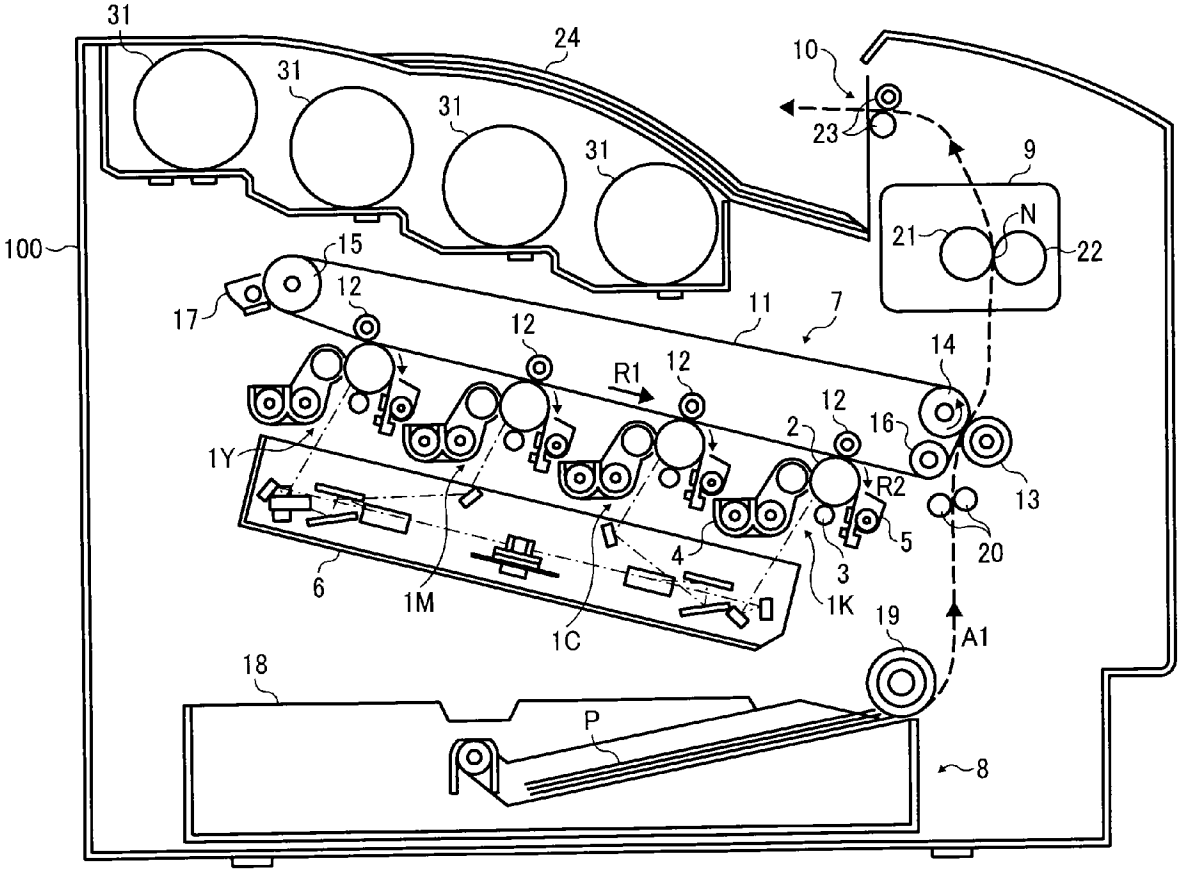
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a tandem color printer that forms color and monochrome toner images on recording media by electrophotography.

With reference to FIG. 1, a description is provided of a construction of the image forming apparatus 100.

As shown in FIG. 1, the image forming apparatus 100 is a color printer that includes four process units 1Y, 1M, 1C, and 1K serving as image forming units or image forming devices detachably attached to the image forming apparatus 100. Although the process units 1Y, 1M, 1C, and 1K contain yellow, magenta, cyan, and black developers (e.g., toners) that form yellow, magenta, cyan, and black toner images, respectively, resulting in a color toner image, they have an identical structure.

Taking the process unit 1K that forms a black toner image, for example, the process unit 1K includes a photoconductor 2 serving as an image carrier that carries an electrostatic latent image and a resultant toner image; a charger 3 that charges an outer circumferential surface of the photoconductor 2; a development device 4 that supplies black toner to the electrostatic latent image formed on the outer circumferential surface of the photoconductor 2, thus visualizing the electrostatic latent image as a black toner image; and a cleaner 5 that cleans the outer circumferential surface of the photoconductor 2. It is to be noted that, in FIG. 1, reference numerals are assigned to the photoconductor 2, the charger 3, the development device 4, and the cleaner 5 of the process unit 1K that forms a black toner image. However, reference numerals for the process units 1Y, 1M, and 1C that form yellow, magenta, and cyan toner images, respectively, are omitted. In an upper portion of the image forming apparatus 100 are four toner bottles 31, detachably attached to the image forming apparatus 100, that contain fresh yellow, magenta, cyan, and black toners, respectively. The fresh yellow, magenta, cyan, and black toners are supplied from the toner bottles 31 to the development devices 4 through toner supply tubes interposed between the toner bottles 31 and the development devices 4, respectively.

The image forming apparatus 100 further includes an exposure device 6 serving as a latent image writer that exposes the outer circumferential surface of the respective photoconductors 2 to form an electrostatic latent image thereon; a transfer device 7 that receives the toner images transferred from the respective photoconductors 2 and transfers the toner images onto a sheet P serving as a recording medium; a sheet feeder 8 that supplies the sheet P to the transfer device 7; a fixing device 9 that fixes the toner image on the sheet P; and an output device 10 that outputs the sheet P bearing the fixed toner image onto an outside of the image forming apparatus 100.

For example, the exposure device 6, constructed of a light source, a polygon mirror, an f-θ lens, reflection mirrors, and the like, emits a laser beam onto the outer circumferential surface of the respective photoconductors 2 according to image data sent from an external device such as a client computer. Alternatively, the exposure device 6 may include a light-emitting diode (LED) head array.

The transfer device 7 includes an intermediate transfer belt 11 serving as an intermediate transferor, four primary transfer rollers 12 serving as primary transferors, a secondary transfer roller 13 serving as a secondary transferor, and a belt cleaner 17. The intermediate transfer belt 11 is an endless belt across which a secondary transfer backup roller 14, a cleaning backup roller 15, and a tension roller 16 are stretched taut. As a driver drives and rotates the secondary transfer backup roller 14 counterclockwise in FIG. 1, the secondary transfer backup roller 14 rotates the intermediate transfer belt 11 counterclockwise in FIG. 1 in a rotation direction R1 by friction therebetween.

The four primary transfer rollers 12 sandwich the intermediate transfer belt 11 together with the four photoconductors 2, respectively, forming four primary transfer nips between the intermediate transfer belt 11 and the photoconductors 2. The primary transfer rollers 12 are connected to a power supply that applies a predetermined direct current voltage and/or alternating current voltage thereto.

The secondary transfer roller 13 sandwiches the intermediate transfer belt 11 together with the secondary transfer backup roller 14, forming a secondary transfer nip between the secondary transfer roller 13 and the intermediate transfer belt 11. Similar to the primary transfer rollers 12, the secondary transfer roller 13 is connected to the power supply that applies a predetermined direct current voltage and/or alternating current voltage thereto.

The belt cleaner 17 includes a cleaning brush and a cleaning blade that contact an outer circumferential surface of the intermediate transfer belt 11. A waste toner conveyance tube extending from the belt cleaner 17 to an inlet of a waste toner container conveys waste toner collected from the intermediate transfer belt 11 by the belt cleaner 17 to the waste toner container.

The sheet feeder 8 includes a paper tray 18 that loads a plurality of sheets P and a feed roller 19 that picks up and feeds an uppermost sheet P from the plurality of sheets P loaded on the paper tray 18. Downstream from the feed roller 19 in a sheet conveyance direction A1 is a registration roller pair 20 serving as a timing roller pair that conveys the sheet P to the secondary transfer nip at a proper time at which the toner image formed on the intermediate transfer belt 11 reaches the secondary transfer nip. The sheets P may be thick paper, postcards, envelopes, plain paper, thin paper, coated paper, art paper, tracing paper, overhead projector (OHP) transparencies, and the like.

The fixing device 9 includes a fixing belt 21 serving as an endless belt or a fixing rotator and a pressure roller 22 serving as an opposed rotator that contacts an outer circumferential surface of the fixing belt 21. The pressure roller 22 contacts the fixing belt 21 to form a fixing nip N therebetween.

The output device 10 includes an output roller pair 23. An output tray 24 is disposed atop the image forming apparatus 100 to receive and stack the sheet P discharged by the output roller pair 23.

With reference to FIG. 1, a description is provided of an image forming operation of the image forming apparatus 100 to form a color toner image on a sheet P.

As a print job starts, a driver drives and rotates the photoconductors 2 of the process units 1Y, 1M, 1C, and 1K, respectively, clockwise in FIG. 1 in a rotation direction R2. The chargers 3 uniformly charge the outer circumferential surface of the respective photoconductors 2 at a predetermined polarity. The exposure device 6 exposes the charged outer circumferential surface of the respective photoconductors 2 according to image data sent from a scanner or an external device such as a client computer, thus forming an electrostatic latent image on the respective photoconductors 2. The image data include yellow, magenta, cyan, and black image data constituting color image data. The development devices 4 supply yellow, magenta, cyan, and black toners to the electrostatic latent images formed on the photoconductors 2, visualizing the electrostatic latent images into yellow, magenta, cyan, and black toner images, respectively.

Simultaneously, as the print job starts, the secondary transfer backup roller 14 over which the intermediate transfer belt 11 is looped is driven and rotated counterclockwise in FIG. 1, rotating the intermediate transfer belt 11 in the rotation direction R1 by friction therebetween. The power supply applies a constant voltage or a constant current control transfer bias having a polarity opposite a polarity of the toner to the primary transfer rollers 12, creating a transfer electric field at each primary transfer nip formed between the photoconductor 2 and the intermediate transfer belt 11.

When the yellow, magenta, cyan, and black toner images formed on the photoconductors 2 reach the primary transfer nips, respectively, in accordance with rotation of the photoconductors 2, the yellow, magenta, cyan, and black toner images are primarily transferred from the photoconductors 2 onto the intermediate transfer belt 11 by the transfer electric field created at the primary transfer nips such that the yellow, magenta, cyan, and black toner images are superimposed successively on a same position on the intermediate transfer belt 11. Thus, a color toner image is formed on the outer circumferential surface of the intermediate transfer belt 11. After the primary transfer of the yellow, magenta, cyan, and black toner images from the photoconductors 2 onto the intermediate transfer belt 11, the cleaners 5 remove residual toner failed to be transferred onto the intermediate transfer belt 11 and therefore remaining on the photoconductors 2 therefrom.

On the other hand, the feed roller 19 disposed in the lower portion of the image forming apparatus 100 is driven and rotated to feed a sheet P from the paper tray 18 toward the registration roller pair 20. As the sheet P comes into contact with the registration roller pair 20, the registration roller pair 20 that interrupts its rotation temporarily halts the sheet P. Thereafter, the registration roller pair 20 resumes its rotation and conveys the sheet P to the secondary transfer nip formed between the secondary transfer roller 13 and the intermediate transfer belt 11 at a time when the color toner image formed on the intermediate transfer belt 11 reaches the secondary transfer nip.

The secondary transfer roller 13 is applied with a transfer bias having a polarity opposite a polarity of the charged yellow, magenta, cyan, and black toners constituting the color toner image formed on the intermediate transfer belt 11, thus creating a transfer electric field at the secondary transfer nip. Alternatively, the secondary transfer backup roller 14 may be applied with a transfer bias having a polarity identical to a polarity of the charged yellow, magenta, cyan, and black toners constituting the color toner image formed on the intermediate transfer belt 11, thus creating a transfer electric field at the secondary transfer nip. The transfer electric field secondarily transfers the yellow, magenta, cyan, and black toner images constituting the color toner image formed on the intermediate transfer belt 11 onto the sheet P collectively. After the secondary transfer of the color toner image from the intermediate transfer belt 11 onto the sheet P, the belt cleaner 17 removes residual toner failed to be transferred onto the sheet P and therefore remaining on the intermediate transfer belt 11 therefrom. The removed toner is conveyed and collected into the waste toner container.

The sheet P bearing the color toner image is conveyed to the fixing device 9 where the fixing belt 21 and the pressure roller 22 apply heat and pressure to the sheet P as the sheet P is conveyed through the fixing nip N formed between the fixing belt 21 and the pressure roller 22, thus fixing the color toner image on the sheet P. Thereafter, the sheet P bearing the fixed color toner image is discharged by the output roller pair 23 onto the outside of the image forming apparatus 100, that is, the output tray 24 that stocks the sheet P.

The above describes the image forming operation of the image forming apparatus 100 to form the color toner image on the sheet P. Alternatively, the image forming apparatus 100 may form a monochrome toner image by using any one of the four process units 1Y, 1M, 1C, and 1K or may form a bicolor or tricolor toner image by using two or three of the process units 1Y, 1M, 1C, and 1K.

Figure 2:
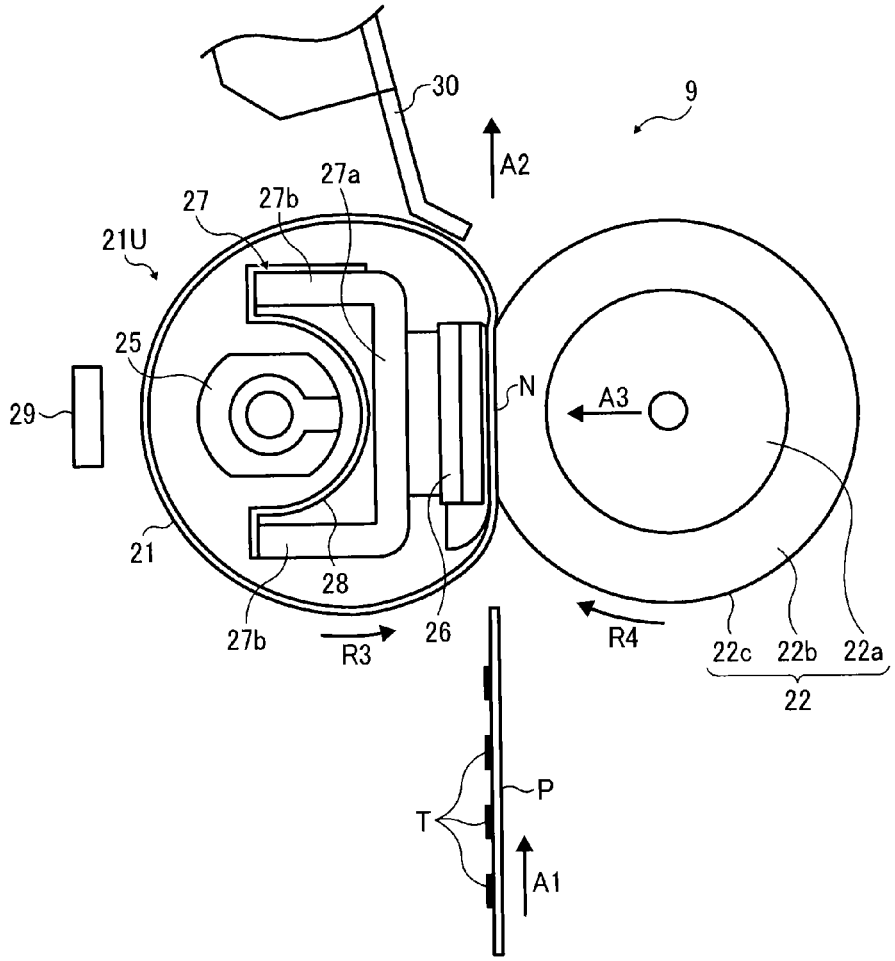
FIG. 2 is a vertical sectional view of a fixing device incorporated in the image forming apparatus shown in FIG. 1.

With reference to FIG. 2, a description is provided of a construction of the fixing device 9 incorporated in the image forming apparatus 100 described above.

FIG. 2 is a vertical sectional view of the fixing device 9. As shown in FIG. 2, the fixing device 9 (e.g., a fuser) includes the fixing belt 21 serving as a fixing rotator or an endless belt formed into a loop and rotatable in a rotation direction R3; a pressure roller 22 serving as an opposed rotator disposed opposite the outer circumferential surface of the fixing belt 21 to separably or unseparably contact the fixing belt 21 and rotatable in a rotation direction R4 counter to the rotation direction R3 of the fixing belt 21; a halogen heater 25 serving as a heater disposed inside the loop formed by the fixing belt 21 to heat the fixing belt 21; a nip formation pad 26 disposed inside the loop formed by the fixing belt 21 and pressing against the pressure roller 22 via the fixing belt 21 to form the fixing nip N between the fixing belt 21 and the pressure roller 22; a stay 27 serving as a support disposed inside the loop formed by the fixing belt 21 and contacting and supporting the nip formation pad 26; a reflector 28 disposed inside the loop formed by the fixing belt 21 to reflect light radiated from the halogen heater 25 toward the fixing belt 21; a temperature sensor 29 serving as a temperature detector disposed opposite the outer circumferential surface of the fixing belt 21 to detect the temperature of the fixing belt 21; and a separator 30 disposed opposite the outer circumferential surface of the fixing belt 21 to separate the sheet P discharged from the fixing nip N from the fixing belt 21. The fixing device 9 further includes a pressurization assembly that presses the pressure roller 22 against the nip formation pad 26 via the fixing belt 21. The fixing belt 21 and the components disposed inside the loop formed by the fixing belt 21, that is, the halogen heater 25, the nip formation pad 26, the stay 27, and the reflector 28, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

According to this exemplary embodiment, the fixing belt 21 is designed to be thin and have a reduced loop diameter so as to decrease the thermal capacity thereof and therefore save energy. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 5 micrometers to about 50 micrometers. Thus, the fixing belt 21 has a total thickness not greater than about 1 mm. A loop diameter of the fixing belt 21 is in a range of from about 20 mm to about 40 mm. The fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressure roller 22 against the nip formation pad 26 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the sheet conveyance direction A1. A driver (e.g., a motor) disposed inside the image forming apparatus 100 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 2, according to this exemplary embodiment, the pressure roller 22 is a solid roller. Alternatively, the pressure roller 22 may be a hollow roller. In this case, a heater such as a halogen heater may be disposed inside the hollow roller. If the pressure roller 22 does not incorporate the elastic layer 22*b*, the pressure roller 22 has a decreased thermal capacity that improves fixing property of being heated to a predetermined fixing temperature quickly. However, as the pressure roller 22 and the fixing belt 21 sandwich and press a toner image T on a sheet P passing through the fixing nip N, slight surface asperities of the fixing belt 21 may be transferred onto the toner image T on the sheet P, resulting in variation in gloss of the solid toner image T. To address this problem, it is preferable that the pressure roller 22 incorporates the elastic layer 22*b* having a thickness not smaller than about 100 micrometers. The elastic layer 22*b* having the thickness not smaller than about 100 micrometers elastically deforms to absorb slight surface asperities of the fixing belt 21, preventing variation in gloss of the toner image T on the sheet P. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

According to this exemplary embodiment, the pressure roller 22 has a diameter in a range of from about 20 mm to about 40 mm that is equivalent to the loop diameter of the fixing belt 21. However, the diameter of the pressure roller 22 is not limited to the above. For example, the loop diameter of the fixing belt 21 may be smaller than the diameter of the pressure roller 22. In this case, a curvature of the fixing belt 21 at the fixing nip N is greater than that of the pressure roller 22, facilitating separation of the sheet P discharged from the fixing nip N from the fixing belt 21.

A detailed description is now given of a configuration of the halogen heater 25.

Both lateral ends of the halogen heater 25 in a longitudinal direction thereof parallel to an axial direction of the fixing belt 21 are mounted on side plates of the fixing device 9, respectively. The power supply situated inside the image forming apparatus 100 supplies power to the halogen heater 25 so that the halogen heater 25 heats the fixing belt 21. A controller (e.g., a processor), that is, a central processing unit (CPU) provided with a random-access memory (RAM) and a read-only memory (ROM), for example, operatively connected to the halogen heater 25 and the temperature sensor 29 controls the halogen heater 25 based on the temperature of the outer circumferential surface of the fixing belt 21 detected by the temperature sensor 29 so as to adjust the temperature of the fixing belt 21 to a desired fixing temperature.

According to this exemplary embodiment, the halogen heater 25 faces the fixing belt 21 directly in a circumferential direct heating span of the fixing belt 21 disposed on the left of the halogen heater 25 in FIG. 2. The fixing device 9 employs a direct heating method in which light radiated from the halogen heater 25 irradiates the fixing belt 21 directly in the circumferential direct heating span of the fixing belt 21. Thus, the fixing device 9 saves energy and shortens a first print time taken to output the sheet P bearing the fixed toner image T upon receipt of a print job. Alternatively, instead of the halogen heater 25, an induction heater, a resistance heat generator, a carbon heater, or the like may be employed as a heater that heats the fixing belt 21.

A detailed description is now given of a configuration of the nip formation pad 26.

A longitudinal direction of the nip formation pad 26 is parallel to the axial direction of the fixing belt 21 or the pressure roller 22. The nip formation pad 26 is mounted on and supported by the stay 27 serving as a support that supports the nip formation pad 26. Accordingly, even if the nip formation pad 26 receives pressure from the pressure roller 22, the nip formation pad 26 is not bent by the pressure and therefore produces a uniform nip width throughout the entire width of the pressure roller 22 in the axial direction thereof.

The nip formation pad 26 is made of a heat resistant material resistant against temperatures of 200 degrees centigrade or higher to prevent thermal deformation of the nip formation pad 26 by temperatures in a fixing temperature range desirable to fix the toner image T on the sheet P, thus retaining the shape of the fixing nip N and quality of the toner image T formed on the sheet P. For example, the nip formation pad 26 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK).

The nip formation pad 26 is coated with a low-friction sheet. As the fixing belt 21 rotates in the rotation direction R3, the fixing belt 21 slides over the low-friction sheet that reduces a driving torque of the fixing belt 21, reducing load exerted to the fixing belt 21 by friction between the fixing belt 21 and the nip formation pad 26. Alternatively, the nip formation pad 26 may be made of a low friction material. In this case, the low-friction sheet is not interposed between the nip formation pad 26 and the fixing belt 21 and therefore the nip formation pad 26 contacts the fixing belt 21 directly.

A detailed description is now given of a configuration of the stay 27.

The stay 27 is made of metal having an increased mechanical strength, such as stainless steel and iron, to prevent bending of the nip formation pad 26. The stay 27 includes arms extending in a pressurization direction A3 in which the pressure roller 22 exerts pressure to the fixing belt 21 and creating an increased length of the stay 27 in the pressurization direction A3 in cross-section, increasing the section modulus of the stay 27 and therefore enhancing the mechanical strength of the stay 27. For example, the stay 27 includes a base 27*a* and a pair of arms 27*b*. The base 27*a* contacts the nip formation pad 26 and extends vertically in FIG. 2 in the sheet conveyance direction A1. The arms 27*b* project from the base 27*a* horizontally leftward in FIG. 2 in the pressurization direction A3 of the pressure roller 22 at an upstream end and a downstream end of the base 27*a* in the sheet conveyance direction A1, respectively. The arms 27*b* projecting from the base 27*a* create an increased length of the stay 27 in the pressurization direction A3 of the pressure roller 22 in cross-section, enhancing the mechanical strength of the stay 27. The halogen heater 25 is interposed between the arms 27*b* of the stay 27 in the sheet conveyance direction A1. Accordingly, even if the fixing belt 21 having a decreased loop diameter produces a confined space inside the loop thereof, the stay 27 allows the fixing belt 21 to accommodate the stay 27, the halogen heater 25, and the like while attaining a desired mechanical strength.

A detailed description is now given of a configuration of the reflector 28.

The reflector 28 is interposed between the stay 27 and the halogen heater 25. According to this exemplary embodiment, the reflector 28 is mounted on the stay 27. The reflector 28 reflects light radiated from the halogen heater 25 to the stay 27 toward the fixing belt 21, increasing an amount of light that irradiates the fixing belt 21 and thereby heating the fixing belt 21 effectively. Additionally, the reflector 28 suppresses conduction of heat from the halogen heater 25 to the stay 27 or the like.

With reference to FIG. 2, a description is provided of a fixing operation of the fixing device 9 described above.

As the image forming apparatus 100 depicted in FIG. 1 is powered on, the power supply supplies power to the halogen heater 25 and at the same time the driver drives and rotates the pressure roller 22 clockwise in FIG. 2 in the rotation direction R4. Accordingly, the fixing belt 21 rotates counterclockwise in FIG. 2 in the rotation direction R3 in accordance with rotation of the pressure roller 22 by friction between the pressure roller 22 and the fixing belt 21.

A sheet P bearing a toner image T formed by the image forming operation of the image forming apparatus 100 described above is conveyed in the sheet conveyance direction A1 while guided by a guide plate and enters the fixing nip N formed between the fixing belt 21 and the pressure roller 22 pressed against the fixing belt 21. The fixing belt 21 heated by the halogen heater 25 heats the sheet P and at the same time the pressure roller 22 pressed against the fixing belt 21, together with the fixing belt 21, exerts pressure to the sheet P, thus fixing the toner image T on the sheet P.

The sheet P bearing the fixed toner image T is discharged from the fixing nip N in a sheet conveyance direction A2. As a leading edge of the sheet P comes into contact with a front edge of the separator 30, the separator 30 separates the sheet P from the fixing belt 21. Thereafter, the separated sheet P is discharged by the output roller pair 23 depicted in FIG. 1 onto the outside of the image forming apparatus 100, that is, the output tray 24 where the sheet P is stocked.

The fixing device 9 may have constructions other than the construction shown in FIG. 2.

Figure 3:
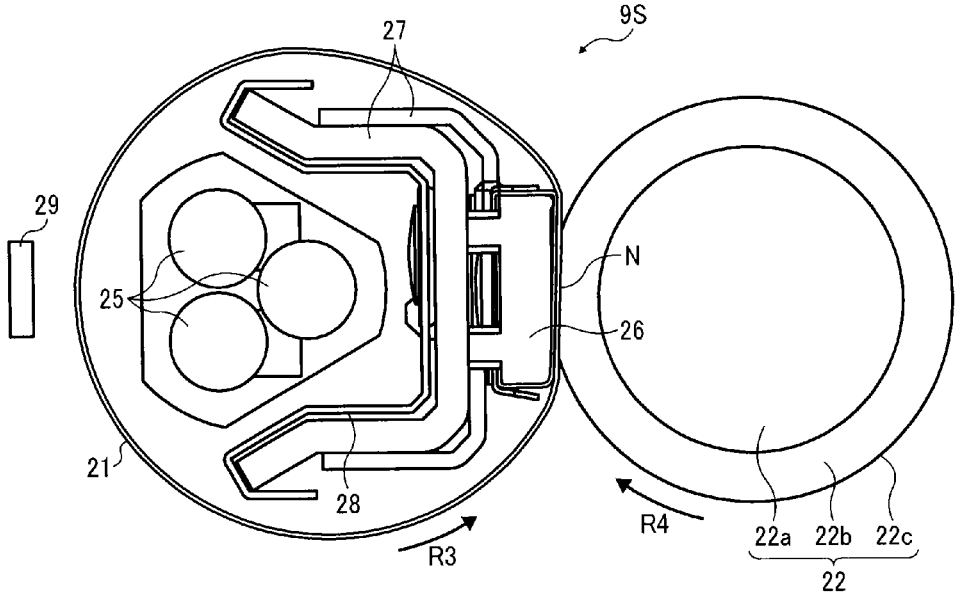
FIG. 3 is a schematic vertical sectional view of a fixing device as a first variation of the fixing device shown in FIG. 2.
Figure 4:
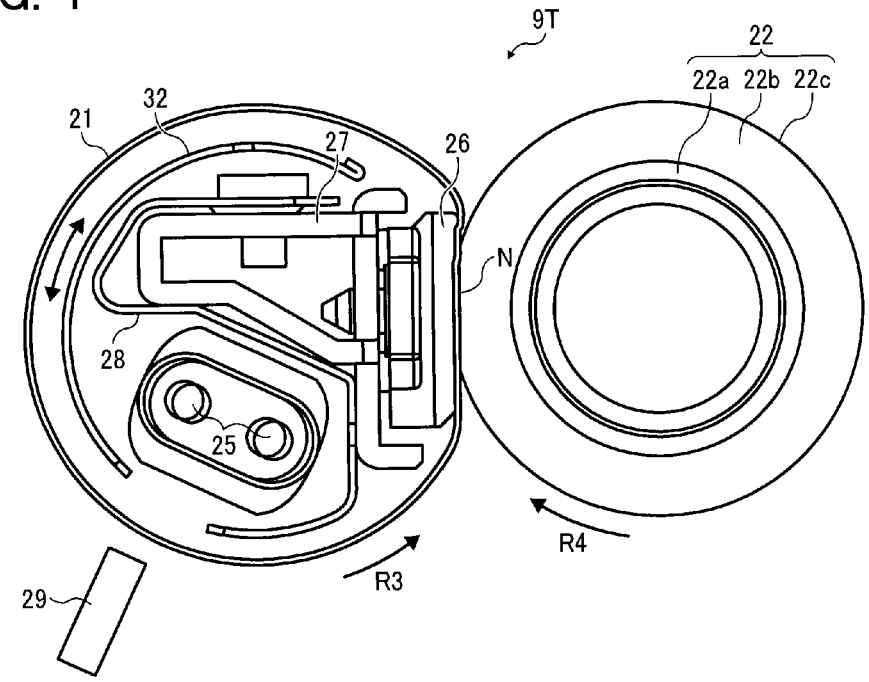
FIG. 4 is a schematic vertical sectional view of a fixing device as a second variation of the fixing device shown in FIG. 2.
Figure 5:
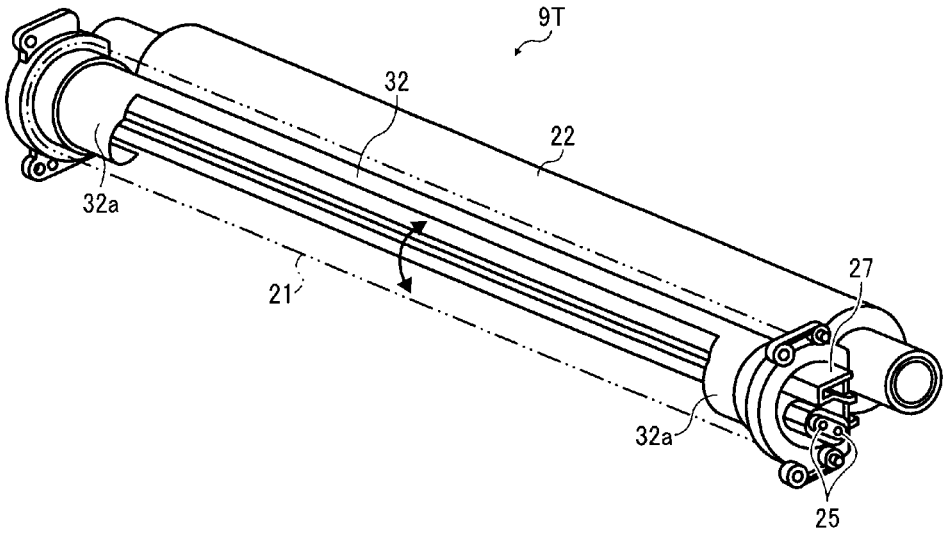
FIG. 5 is a perspective view of the fixing device shown in FIG. 4.

With reference to FIGS. 3 to 5, a description is provided of variations of the fixing device 9.

FIG. 3 is a schematic vertical sectional view of a fixing device 9S as a first variation. As shown in FIG. 3, the fixing device 9S includes a plurality of halogen heaters 25. According to this exemplary embodiment, the fixing device 9S includes three halogen heaters 25. The plurality of halogen heaters 25 has a plurality of heat generation spans in the longitudinal direction thereof different from each other, respectively, which corresponds to a plurality of widths of sheets P of a plurality of sizes. Thus, the halogen heaters 25 heat the fixing belt 21 in an axial heating span thereof varying depending on the plurality of sizes of sheets P.

FIG. 4 is a schematic vertical sectional view of a fixing device 9T as a second variation. FIG. 5 is a perspective view of the fixing device 9T. As shown in FIG. 4, the fixing device 9T includes two halogen heaters 25 and a heat shield 32 situated inside the loop formed by the fixing belt 21 to shield the fixing belt 21 from the halogen heaters 25. The heat shield 32 is movable in a circumferential direction of the fixing belt 21. As shown in FIG. 5, the heat shield 32 includes shield portions 32*a* disposed at both lateral ends of the heat shield 32 in a longitudinal direction thereof parallel to the axial direction of the fixing belt 21, respectively. The shield portions 32*a* shield both lateral ends of the fixing belt 21 in the axial direction thereof from the halogen heaters 25. As small sheets P having a width smaller than a light emission span of the halogen heaters 25 in the longitudinal direction thereof are conveyed over the fixing belt 21 continuously, a non-conveyance span of the fixing belt 21 situated at each lateral end of the fixing belt 21 in the axial direction thereof where the small sheets P are not conveyed may overheat because the small sheets P do not draw heat from each lateral end of the fixing belt 21 in the axial direction thereof. To address this circumstance, the shield portion 32*a* disposed opposite each lateral end of the fixing belt 21 in the axial direction thereof and interposed between the halogen heaters 25 and the fixing belt 21 shields the fixing belt 21 from the halogen heaters 25, preventing overheating of each lateral end of the fixing belt 21 in the axial direction thereof.

The shape of the nip formation pad 26, the stay 27, and the reflector 28 may be modified as shown in FIGS. 3 to 5.

With reference to FIGS. 6 to 10, a description is provided of a construction of a comparative fixing device 9C.

Figure 6:
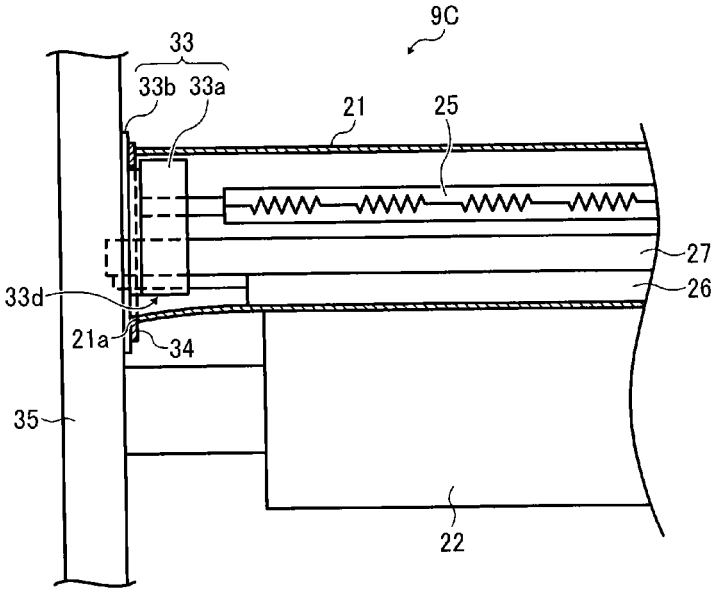
FIG. 6 is a partial horizontal sectional view of a comparative fixing device.

FIG. 6 is a partial horizontal sectional view of the comparative fixing device 9C illustrating one lateral end of the fixing device 9C in a longitudinal direction thereof. Like the fixing device 9 shown in FIG. 2, the comparative fixing device 9C shown in FIG. 6 includes the fixing belt 21, the pressure roller 22, the halogen heater 25, the nip formation pad 26, and the stay 27. FIG. 6 illustrates a cross-section of the fixing belt 21 in the axial direction thereof.

As shown in FIG. 6, a tubular belt holder 33 is inserted into one lateral end of the fixing belt 21 in the axial direction thereof. Although not shown, another tubular belt holder 33 is inserted into another lateral end of the fixing belt 21 in the axial direction thereof. Thus, the two belt holders 33 rotatably support the fixing belt 21. The belt holder 33 includes a substantially tubular, holding portion 33*a* inserted into the lateral end of the fixing belt 21 in the axial direction thereof and a flange 33*b* mounted on a side plate 35 of the comparative fixing device 9C. The flange 33*b* is molded with an outboard end of the holding portion 33*a* in the axial direction of the fixing belt 21 and is greater than the holding portion 33*a* in diameter. A slip ring 34 serving as a ring is placed on an outer circumferential surface of the holding portion 33*a* and interposed between the flange 33*b* and a lateral edge face 21*a* of the fixing belt 21 in the axial direction of the fixing belt 21. According to this exemplary embodiment, the slip ring 34 is circular in cross-section. Alternatively, the slip ring 34 may be C-shaped in cross-section with a slit at a part of the slip ring 34 in a circumferential direction thereof.

Figure 7:
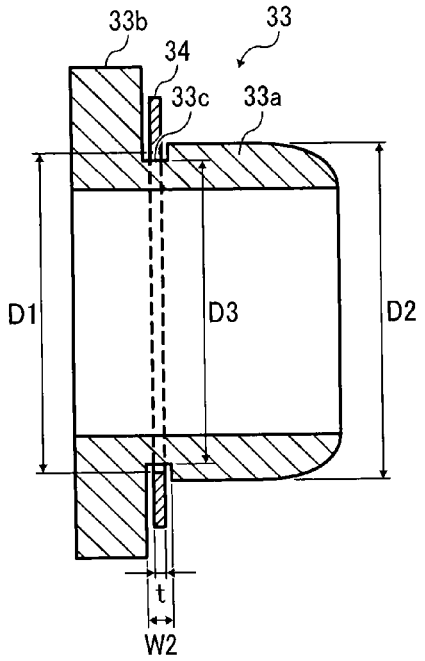
FIG. 7 is a sectional view of a belt holder and a slip ring incorporated in the comparative fixing device shown in FIG. 6.

FIG. 7 is a sectional view of the belt holder 33 and the slip ring 34. As shown in FIG. 7, a groove 33*c* is produced in an outer circumferential face of the holding portion 33*a* and contiguous to the flange 33*b*. The groove 33*c* extends throughout an entire circumference of the holding portion 33*a* to engage the slip ring 34. The slip ring 34 is inserted from an inboard edge of the holding portion 33*a* into the groove 33*c*. Although an inner diameter D1 of the slip ring 34 is smaller than an outer diameter D2 of the holding portion 33*a*, the slip ring 34 elastically deforms as the slip ring 34 moves over the holding portion 33*a* and engages the groove 33*c*. For example, the slip ring 34 is made of heat resistant, super engineering plastics such as PEEK, PPS, and PAI. Although the material of the belt holder 33 is determined by considering the material of the base layer of the fixing belt 21 and the heat resistant temperature affected by load imposed from the sheet P to the fixing belt 21, the belt holder 33 is made of heat resistant resin such as PPS, PAI, LCP, and polyetherketone (PEK).

As shown in FIG. 7, the inner diameter D1 of the slip ring 34 is greater than a diameter D3 defined by a bottom of the groove 33*c*. A width W2 of the groove 33*c* in the axial direction of the fixing belt 21 is greater than a thickness t of the slip ring 34 in the axial direction of the fixing belt 21. Thus, the slip ring 34 is rotatably fitted into the groove 33*c*.

Figure 8:
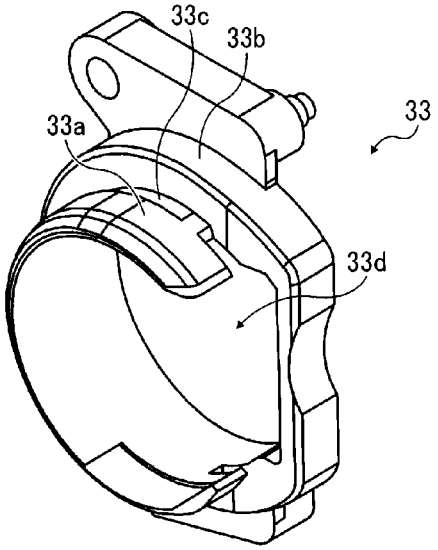
FIG. 8 is a perspective view of the belt holder shown in FIG. 7.

FIG. 8 is a perspective view of the belt holder 33. As shown in FIG. 8, the holding portion 33*a* includes a slit 33*d* at a part of a circumference of the holding portion 33*a*.

Figure 9:
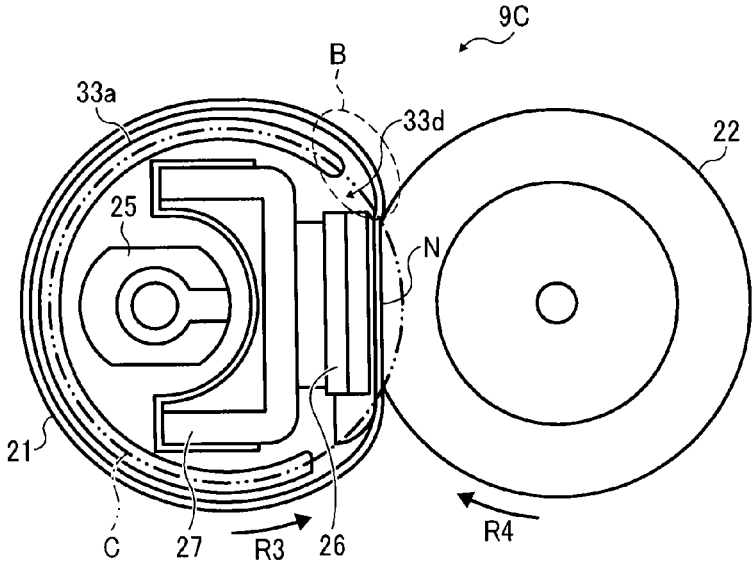
FIG. 9 is a schematic vertical sectional view of the comparative fixing device shown in FIG. 6.

FIG. 9 is a schematic vertical sectional view of the comparative fixing device 9C. As shown in FIG. 9, in order to facilitate separation of the sheet P from the fixing belt 21, the nip formation pad 26 projects radially to a position overlapping a hypothetical circle C defined by the C-shaped holding portion 33*a* in cross-section so as to increase a curvature of the fixing belt 21 at a position in proximity to an exit of the fixing nip N that is indicated by a dotted circle B. Accordingly, if the holding portion 33*a* is tubular or cylindrical and therefore contoured into an endless loop in cross-section, the holding portion 33*a* may interfere with the nip formation pad 26. To address this circumstance, the holding portion 33*a* includes the slit 33*d* disposed opposite a circumferential span of the fixing belt 21 corresponding to the fixing nip N.

With the construction of the comparative fixing device 9C described above, as the fixing belt 21 rotates in the rotation direction R3, if the fixing belt 21 is skewed in the axial direction thereof by a force that moves the fixing belt 21 toward one of the belt holders 33, one lateral end of the fixing belt 21 in the axial direction thereof comes into contact with the slip ring 34. Since the slip ring 34 is loosely fitted into the groove 33*c* of the holding portion 33*a* as shown in FIG. 7, as the lateral end of the fixing belt 21 contacts the slip ring 34, the slip ring 34 rotates in accordance with rotation of the fixing belt 21. Alternatively, instead of rotating in accordance with rotation of the fixing belt 21, the slip ring 34 may be stationary. As the lateral end of the fixing belt 21 contacts the slip ring 34, the slip ring 34 prohibits the lateral end of the fixing belt 21 from coming into contact with the flange 33*b*, preventing abrasion and breakage of the fixing belt 21. The slip ring 34 is made of a material that is abrasion-resistant less than a material of the flange 33*b*. Hence, the slip ring 34 is more susceptible to abrasion than the flange 33*b*, preventing abrasion of the flange 33*b*.

Figure 10:
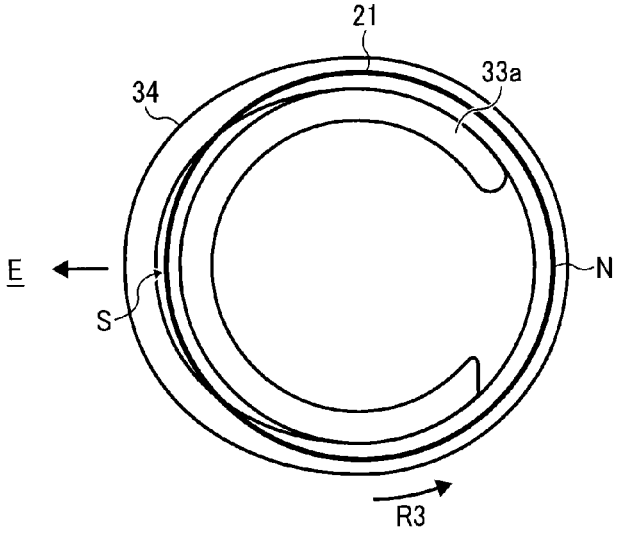
FIG. 10 is a vertical sectional view of a fixing belt, the belt holder, and the slip ring incorporated in the comparative fixing device shown in FIG. 9.

FIG. 10 is a vertical sectional view of the fixing belt 21, the holding portion 33*a* of the belt holder 33, and the slip ring 34 incorporated in the comparative fixing device 9C. As the fixing belt 21 rotates in the rotation direction R3, the slip ring 34 receives a force directed downstream in the rotation direction R3 of the fixing belt 21 or a force directed leftward in FIG. 10 to move the slip ring 34 from a trajectory of the rotating fixing belt 21 at a position in proximity to the exit of the fixing nip N. Accordingly, as shown in FIG. 10, the slip ring 34 moves toward an opposite position E opposite the fixing nip N. Consequently, at the opposite position E, an increased gap S is created between an inner circumferential surface of the slip ring 34 and the outer circumferential surface of the holding portion 33*a*. As a result, the lateral end of the fixing belt 21 may enter the gap S accidentally. When the lateral end of the fixing belt 21 entering the gap S surmounts the slip ring 34 as the fixing belt 21 rotates, the base layer of the fixing belt 21 may be caught in an inner edge of the slip ring 34. Thereafter, as the fixing belt 21 is released from the inner edge of the slip ring 34, substantial scratch noise may occur. Additionally, as the fixing belt 21 is skewed in the axial direction thereof by a substantial force, the fixing belt 21 may deform substantially, resulting in breakage such as crack of the lateral end of the fixing belt 21.

To address this circumstance of the comparative fixing device 9C, the fixing device 9 is configured as below.

With reference to FIGS. 11 to 16, a description is provided of a configuration of a restraint 36 according to a first exemplary embodiment that is installed in the fixing device 9.

Figure 11:
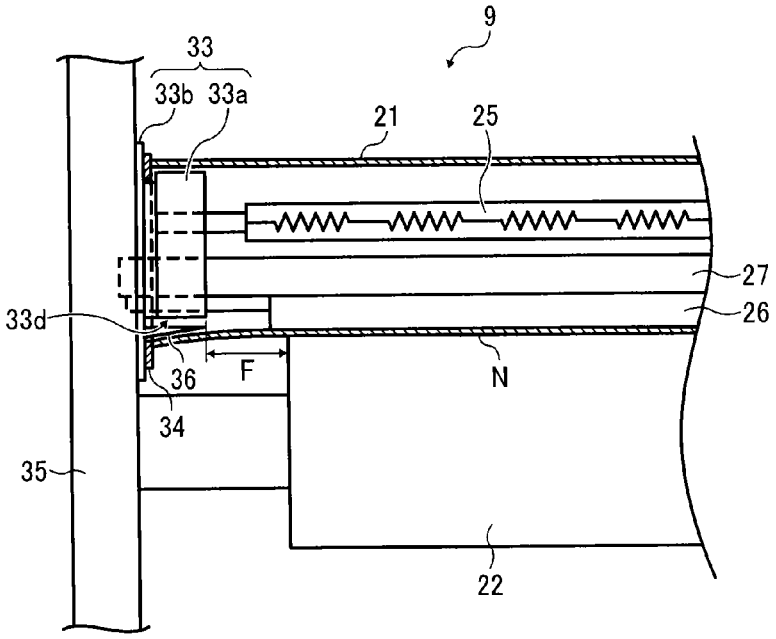
FIG. 11 is a partial horizontal sectional view of the fixing device shown in FIG. 2.
Figure 12:
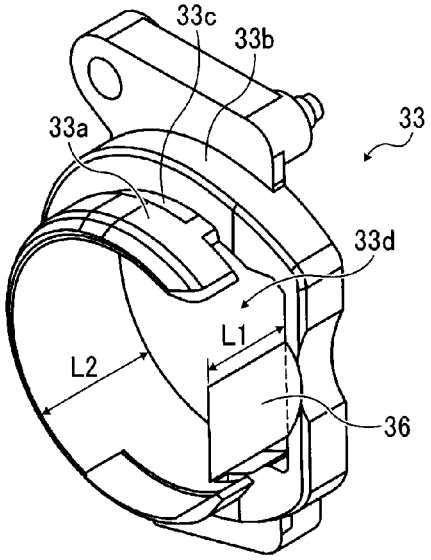
FIG. 12 is a perspective view of the belt holder incorporated in the fixing device shown in FIG. 11.

FIG. 11 is a partial horizontal sectional view of the fixing device 9 illustrating one lateral end of the fixing device 9 in a longitudinal direction thereof. FIG. 12 is a perspective view of the belt holder 33 of the fixing device 9. As shown in FIGS. 11 and 12, the fixing device 9 includes the restraint 36, disposed opposite the inner circumferential surface of the slip ring 34 through the slit 33*d* of the belt holder 33, to restrict radial movement or displacement of the slip ring 34. Components of the fixing device 9 are equivalent to those of the comparative fixing device 9C depicted in FIGS. 6 to 10 except the restraint 36. Although FIG. 11 illustrates the restraint 36 situated at one lateral end of the fixing device 9 in the longitudinal direction thereof, another restraint 36 is situated at another lateral end of the fixing device 9 in the longitudinal direction thereof.

As shown in FIG. 11, in order to prevent substantial, local warping or deformation of the fixing belt 21 at a position between a lateral edge of the fixing belt 21 and the fixing nip N in the axial direction thereof, an interval F in a range of from about 10 mm to about 20 mm is provided between an inward edge of the holding portion 33*a* and a lateral edge of the elastic layer 22*b* of the pressure roller 22 in the axial direction of the fixing belt 21. Accordingly, the nip formation pad 26 and the elastic layer 22*b* of the pressure roller 22 are not disposed in the slit 33*d* of the belt holder 33, securing a space. Additionally, the fixing nip N is not formed between the pressure roller 22 and the fixing belt 21 in the slit 33*d*, allowing the fixing belt 21 to move radially. Hence, the restraint 36 is situated in the slit 33*d* securing the space.

The restraint 36 projects from the flange 33*b* in the axial direction of the fixing belt 21 and is molded with the belt holder 33. As shown in FIG. 12, a projection length of the restraint 36 in the axial direction of the fixing belt 21, that is, a first length L1 of the restraint 36 from the flange 33*b*, is not greater than a second length L2 of the holding portion 33*a* in the axial direction of the fixing belt 21.

Figure 13:
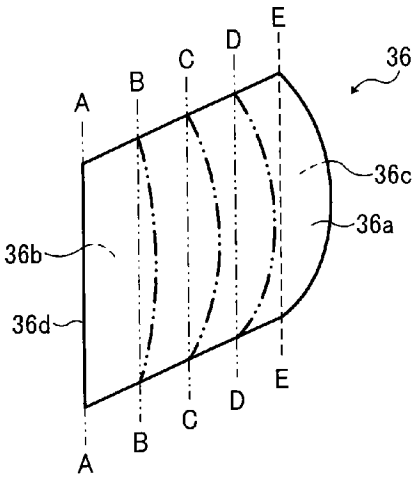
FIG. 13 is a perspective view of a restraint according to a first exemplary embodiment, which is incorporated in the fixing device shown in FIG. 11.
Figure 14A:
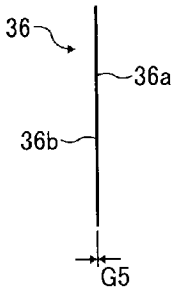
FIG. 14A is a sectional view of the restraint taken along line A-A in FIG. 13.
Figure 14B:
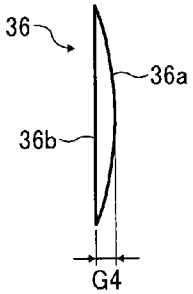
FIG. 14B is a sectional view of the restraint taken along line B-B in FIG. 13.
Figure 14C:
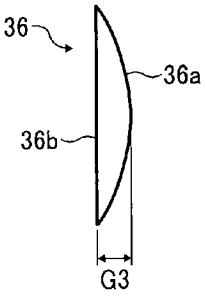
FIG. 14C is a sectional view of the restraint taken along line C-C in FIG. 13.
Figure 14D:
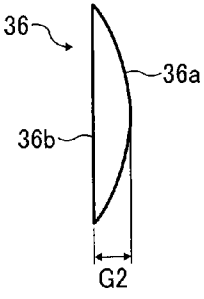
FIG. 14D is a sectional view of the restraint taken along line D-D in FIG. 13.
Figure 14E:
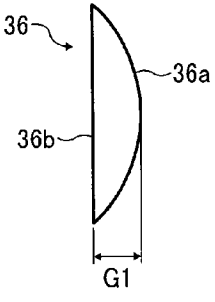
FIG. 14E is a sectional view of the restraint taken along line E-E in FIG. 13.

FIG. 13 is a perspective view of the restraint 36. FIG. 14A is a sectional view of the restraint 36 taken along line A-A in FIG. 13. FIG. 14B is a sectional view of the restraint 36 taken along line B-B in FIG. 13. FIG. 14C is a sectional view of the restraint 36 taken along line C-C in FIG. 13. FIG. 14D is a sectional view of the restraint 36 taken along line D-D in FIG. 13. FIG. 14E is a sectional view of the restraint 36 taken along line E-E in FIG. 13.

As shown in FIG. 13, the restraint 36 includes a restraint face 36*a*, an inner face 36*b*, an outboard end 36*c*, and an inboard end 36*d*. The restraint face 36*a* is bulged and curved outward in a radial direction of the holding portion 33*a*. Conversely, the inner face 36*b* opposite the restraint face 36*a* is planar. A maximum height of the restraint face 36*a* from the inner face 36*b*, that is, bulge amounts G1 to G5 of the restraint face 36*a*, in the radial direction of the holding portion 33*a* decreases gradually from the outboard end 36*c* disposed opposite the slip ring 34 to the inboard end 36*d* disposed inboard from the outboard end 36*c* in the axial direction of the fixing belt 21 toward the fixing nip N.

For example, as shown in FIGS. 14B to 14E illustrating cross-section of the restraint face 36*a*, the restraint face 36*a* is curved into an arch. However, since the radius of the arcuate restraint face 36*a* increases gradually from the outboard end 36*c* toward the fixing nip N, that is, to the inboard end 36*d*, the bulge amounts G1 to G4 decrease gradually. At the inboard end 36*d* in proximity to the fixing nip N shown in FIG. 14A, the restraint face 36*a* is straight and the bulge amount G5 is substantially zero.

Figure 15:
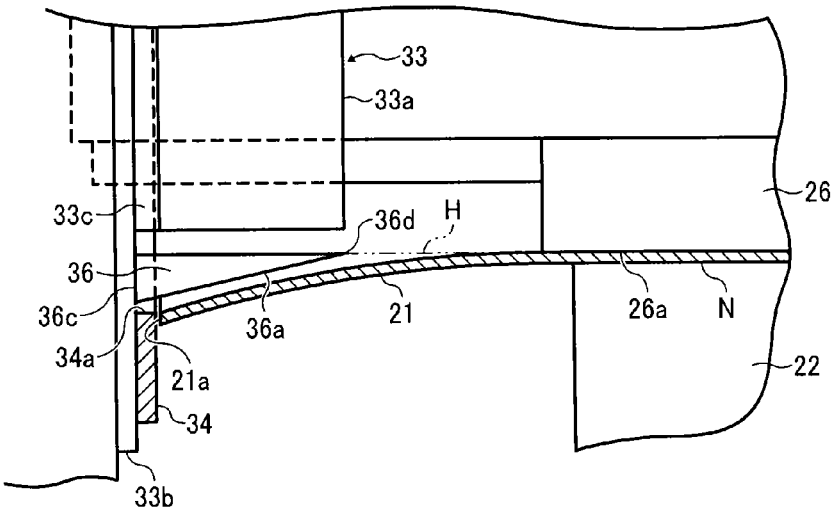
FIG. 15 is a partial horizontal sectional view of the belt holder, the slip ring, and the restraint incorporated in the fixing device shown in FIG. 11.

FIG. 15 is a partial horizontal sectional view of the belt holder 33, the slip ring 34, and the restraint 36. As shown in FIG. 15, since the bulge amount of the restraint face 36*a* decreases gradually from the outboard end 36*c* toward the fixing nip N, that is, to the inboard end 36*d*, a ridge line of the sloped restraint face 36*a* is blended into a hypothetical extension H of a nip formation face 26*a* of the nip formation pad 26 that contacts the fixing belt 21. According to this exemplary embodiment, the inboard end 36*d* of the restraint face 36*a* in proximity to the fixing nip N is on the hypothetical extension H of the nip formation face 26*a* extending in the axial direction of the fixing belt 21. That is, the inboard end 36*d* is leveled with the nip formation face 26*a* in a radial direction of the fixing belt 21.

Conversely, the bulge amount of the restraint face 36*a* increases at a position in proximity to the slip ring 34. Hence, the restraint face 36*a* is close to an inner face 34*a* of the slip ring 34. According to this exemplary embodiment, the outboard end 36*c* of the restraint face 36*a* disposed opposite the slip ring 34 is formed in an arch having a diameter equivalent to a diameter of the groove 33*c* that engages the slip ring 34.

Figure 16:
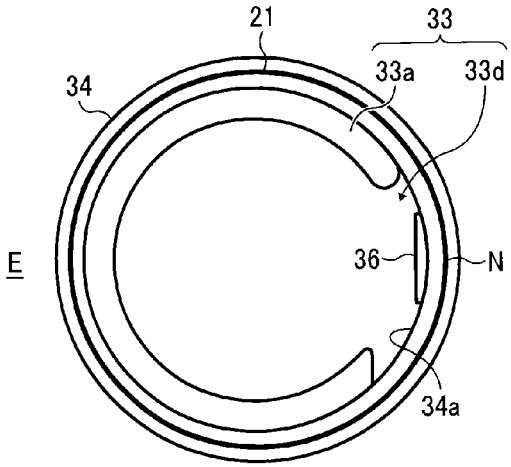
FIG. 16 is a vertical sectional view of the fixing belt, the slip ring, and the restraint incorporated in the fixing device shown in FIG. 11.

FIG. 16 is a vertical sectional view of the fixing belt 21, the slip ring 34, and the restraint 36. As shown in FIG. 16, the restraint 36 supports the slip ring 34 by contacting the inner face 34*a* of the slip ring 34 at the slit 33*d* of the belt holder 33. Accordingly, the restraint 36 restricts movement of the slip ring 34 toward the opposite position E opposite the fixing nip N, preventing creation of the gap S between the inner face 34*a* of the slip ring 34 and the outer circumferential surface of the holding portion 33*a* of the belt holder 33 depicted in FIG. 10 at the opposite position E opposite the fixing nip N. Consequently, the lateral end of the fixing belt 21 in the axial direction thereof does not enter the gap S between the inner face 34*a* of the slip ring 34 and the outer circumferential surface of the holding portion 33*a* of the belt holder 33, preventing noise and breakage of the lateral end of the fixing belt 21 in the axial direction thereof.

As shown in FIG. 15, the bulge amount of the restraint face 36*a* decreases gradually from the outboard end 36*c* to the inboard end 36*d* so that the sloped restraint face 36*a* of the restraint 36 is blended into and leveled with the nip formation face 26*a* of the nip formation pad 26 in the radial direction of the fixing belt 21. Accordingly, the belt holder 33 supports the fixing belt 21 such that the diameter of the fixing belt 21 changes gently. For example, the belt holder 33 supports the lateral end of the fixing belt 21 in the axial direction thereof such that the lateral end of the fixing belt 21 retains a substantially circular shape in cross-section. Conversely, a portion of the fixing belt 21 in proximity to the fixing nip N in the axial direction thereof that is not supported by the belt holder 33 is not formed in the substantially circular shape in cross-section. The diameter of the fixing belt 21 changes gently to reduce load unnecessarily imposed to the fixing belt 21, facilitating stable rotation of the fixing belt 21.

Figure 17:
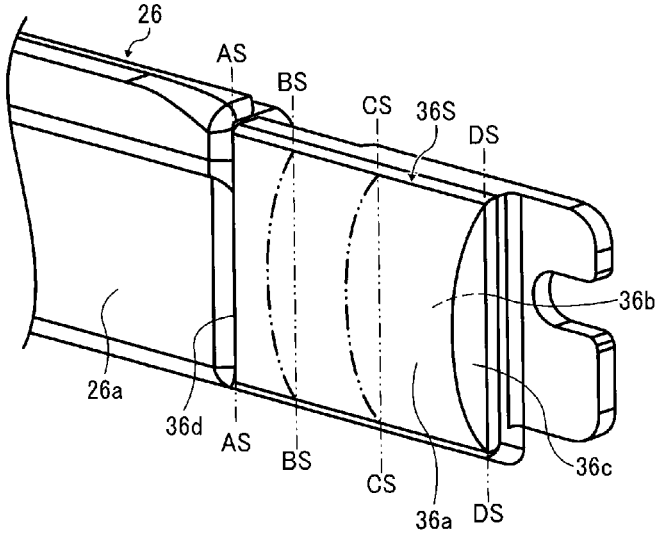
FIG. 17 is a perspective view of a restraint according to a second exemplary embodiment.
Figures 18A, 18B, 18C, 18D:
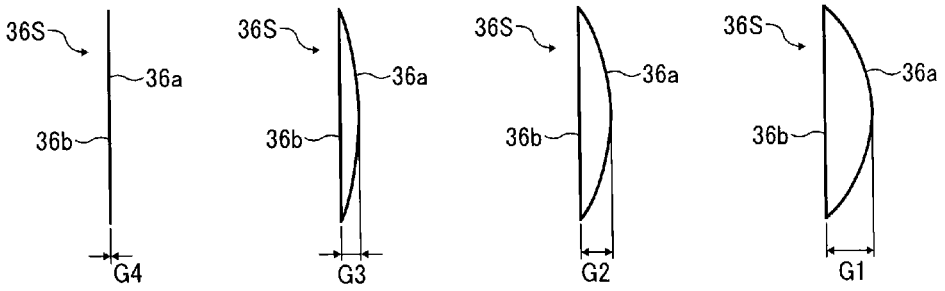
FIG. 18A is a sectional view of the restraint taken along line AS-AS in FIG. 17.
FIG. 18B is a sectional view of the restraint taken along line BS-BS in FIG. 17.
FIG. 18C is a sectional view of the restraint taken along line CS-CS in FIG. 17.
FIG. 18D is a sectional view of the restraint taken along line DS-DS in FIG. 17.

With reference to FIGS. 17 to 18D, a description is provided of a configuration of a restraint 36S according to a second exemplary embodiment that is installable in the fixing devices 9, 9S, and 9T depicted in FIGS. 2, 3, and 4, respectively.

FIG. 17 is a perspective view of the restraint 36S. FIG. 18A is a sectional view of the restraint 36S taken along line AS-AS in FIG. 17. FIG. 18B is a sectional view of the restraint 36S taken along line BS-BS in FIG. 17. FIG. 18C is a sectional view of the restraint 36S taken along line CS-CS in FIG. 17. FIG. 18D is a sectional view of the restraint 36S taken along line DS-DS in FIG. 17.

As shown in FIG. 17, the restraint 36S adjoins a lateral end of the nip formation pad 26 in the longitudinal direction thereof. The restraint 36S projects beyond an outer circumferential surface of the lateral end of the nip formation pad 26 in the radial direction of the fixing belt 21. Accordingly, compared to the restraint 36 projecting from the belt holder 33 in the axial direction of the fixing belt 21 as shown in FIG. 15, the restraint 36S has an increased thickness and an increased mechanical strength. The restraint 36S is equivalent to the restraint 36 depicted in FIGS. 11 to 16 in other configuration.

As shown in FIGS. 18A to 18D illustrating cross-section of the restraint face 36*a*, the restraint face 36*a* is curved into an arch. However, since the radius of the restraint face 36*a* increases gradually from the outboard end 36*c* to the inboard end 36*d*, that is, toward the fixing nip N, the bulge amounts G1 to G4 of the restraint face 36*a* bulging in the radial direction of the fixing belt 21 decrease gradually from the outboard end 36*c* to the inboard end 36*d*. Like the restraint face 36*a* of the restraint 36 depicted in FIGS. 14A to 14E, the bulge amounts G1 to G4 of the restraint face 36*a* of the restraint 36S decrease gradually from the outboard end 36*c* to the inboard end 36*d* so that the sloped restraint face 36*a* of the restraint 36S is blended into and leveled with the nip formation face 26*a* of the nip formation pad 26 in the radial direction of the fixing belt 21.

As the nip formation pad 26 is installed in the fixing device 9, 9S, or 9T, like the restraint 36 depicted in FIG. 16, the restraint 36S adjoining the nip formation pad 26 is disposed opposite the inner face 34*a* of the slip ring 34 through the slit 33*d* of the belt holder 33.

Accordingly, the restraint 36S supports the slip ring 34 by contacting the inner face 34*a* thereof. Consequently, the restraint 36S restricts movement of the slip ring 34 toward the opposite position E opposite the fixing nip N, preventing creation of the gap S between the inner face 34*a* of the slip ring 34 and the outer circumferential surface of the holding portion 33*a* of the belt holder 33 depicted in FIG. 10 at the opposite position E opposite the fixing nip N. Hence, the lateral end of the fixing belt 21 in the axial direction thereof does not enter the gap S between the inner face 34*a* of the slip ring 34 and the outer circumferential surface of the holding portion 33*a* of the belt holder 33, preventing noise and breakage of the lateral end of the fixing belt 21 in the axial direction thereof.

The restraint face 36*a* of the restraint 36S is blended into and leveled with the nip formation face 26*a* of the nip formation pad 26 in the radial direction of the fixing belt 21, reducing load unnecessarily imposed to the fixing belt 21 and supporting the fixing belt 21 stably.

Figure 19:
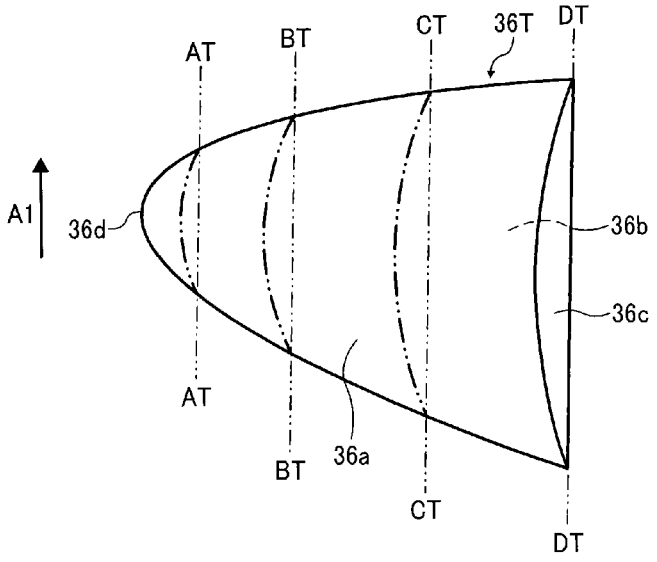
FIG. 19 is a perspective view of a restraint as a variation of the restraint shown in FIG. 17.
Figures 20A, 20B, 20C, 20D:
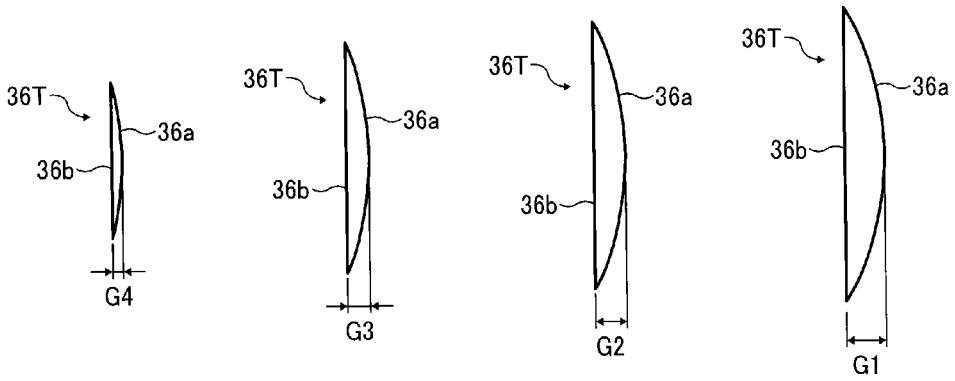
FIG. 20A is a sectional view of the restraint taken along line AT-AT in FIG. 19.
FIG. 20B is a sectional view of the restraint taken along line BT-BT in FIG. 19.
FIG. 20C is a sectional view of the restraint taken along line CT-CT in FIG. 19.
FIG. 20D is a sectional view of the restraint taken along line DT-DT in FIG. 19.

With reference to FIGS. 19 to 20D, a description is provided of a configuration of a restraint 36T as a variation of the restraint 36S depicted in FIGS. 17 to 18D.

FIG. 19 is a perspective view of the restraint 36T. FIG. 20A is a sectional view of the restraint 36T taken along line AT-AT in FIG. 19. FIG. 20B is a sectional view of the restraint 36T taken along line BT-BT in FIG. 19. FIG. 20C is a sectional view of the restraint 36T taken along line CT-CT in FIG. 19. FIG. 20D is a sectional view of the restraint 36T taken along line DT-DT in FIG. 19.

As shown in FIG. 19, the arcuate restraint face 36*a* of the restraint 36T has an arch length in the sheet conveyance direction A1 that decreases gradually from the outboard end 36*c* to the inboard end 36*d*. The radius of the arcuate restraint face 36*a* of the restraint 36S increases gradually from the outboard end 36*c* to the inboard end 36*d*, that is, toward the fixing nip N, as shown in FIG. 17. Conversely, the radius of the arcuate restraint face 36*a* of the restraint 36T is even from the outboard end 36*c* to the inboard end 36*d* as shown in FIG. 19. However, since the arch length of the arcuate restraint face 36*a* of the restraint 36T in the sheet conveyance direction A1 decreases gradually from the outboard end 36*c* to the inboard end 36*d*, the bulge amounts G1 to G4 of the restraint face 36*a* of the restraint 36T decrease gradually. In this case also, like the restraint 36S, the restraint 36T reduces load unnecessarily imposed to the fixing belt 21.

According to the exemplary embodiments described above, the restraint 36 adjoins or is mounted on the belt holder 33, the restraint 36S adjoins or is mounted on the nip formation pad 26, and the restraint 36T adjoins or is mounted on the belt holder 33 or the nip formation pad 26. Alternatively, the restraints 36, 36S, and 36T may adjoin or may be mounted on the side plate 35 depicted in FIG. 11 or the like of the fixing devices 9, 9S, and 9T.

Figure 21:
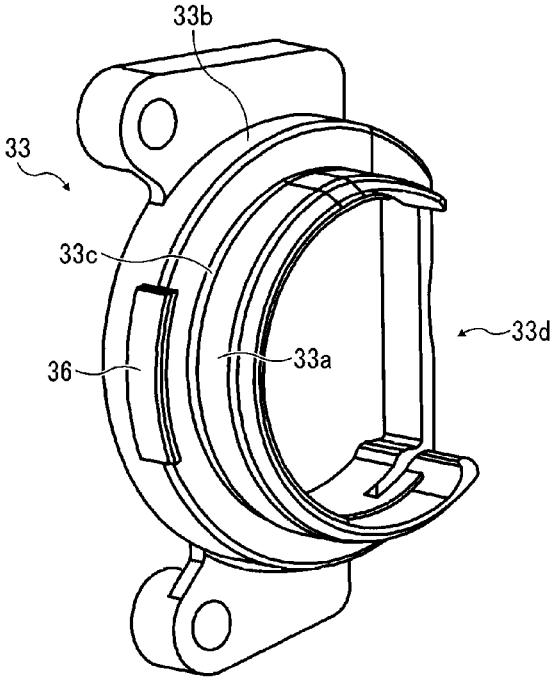
FIG. 21 is a perspective view of the belt holder and the restraint according to a third exemplary embodiment.
Figure 22:
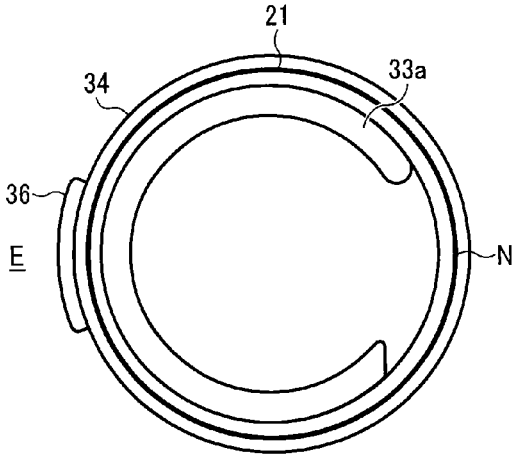
FIG. 22 is a vertical sectional view of the fixing belt, the slip ring, and the restraint shown in FIG. 21 that is disposed opposite the slip ring.

With reference to FIGS. 21 and 22, a description is provided of a configuration of the restraint 36 according to a third exemplary embodiment.

FIG. 21 is a perspective view of the belt holder 33 and the restraint 36. FIG. 22 is a vertical sectional view of the fixing belt 21, the slip ring 34, and the restraint 36. As shown in FIG. 21, according to the third exemplary embodiment, the restraint 36 adjoins or is mounted on the flange 33*b* of the belt holder 33. For example, the arcuate restraint 36 is disposed opposite the groove 33*c* that engages the slip ring 34 at a position opposite the slit 33*d* of the holding portion 33*a* of the belt holder 33, that is, the opposite position E opposite the fixing nip N depicted in FIG. 22. The restraint 36 depicted in FIG. 21 is equivalent to the restraint 36 depicted in FIGS. 11 to 16 in other configuration.

As the slip ring 34 engages the belt holder 33, the restraint 36 is disposed opposite an outer circumferential surface of the slip ring 34 as shown in FIG. 22. The restraint 36 contacts the outer circumferential surface of the slip ring 34 at the opposite position E opposite the fixing nip N, restricting movement of the slip ring 34 to the opposite position E opposite the fixing nip N. Accordingly, like the restraints 36, 36S, and 36T according to the exemplary embodiments described above, the restraint 36 depicted in FIGS. 21 and 22 prevents creation of the gap S between the inner face 34*a* of the slip ring 34 and the outer circumferential surface of the holding portion 33*a* of the belt holder 33 depicted in FIG. 10 at the opposite position E opposite the fixing nip N. Consequently, the lateral end of the fixing belt 21 in the axial direction thereof does not enter the gap S between the inner face 34*a* of the slip ring 34 and the outer circumferential surface of the holding portion 33*a* of the belt holder 33, preventing noise and breakage of the lateral end of the fixing belt 21 in the axial direction thereof.

Figure 23:
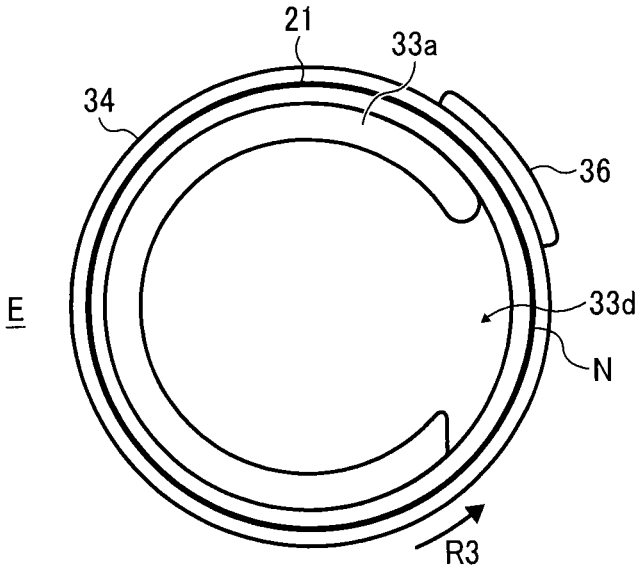
FIG. 23 is a vertical sectional view of the fixing belt, the slip ring, and the restraint as a variation of the restraint shown in FIG. 22.

With reference to FIG. 23, a description is provided of a configuration of the restraint 36 as a variation of the restraint 36 shown in FIG. 22.

FIG. 23 is a vertical sectional view of the fixing belt 21, the slip ring 34, and the restraint 36. As shown in FIG. 23, the restraint 36 may be situated in proximity to a downstream end of the slit 33*d* of the holding portion 33*a* of the belt holder 33 in the rotation direction R3 of the fixing belt 21, that is, at a position in proximity to the exit of the fixing nip N. When the fixing belt 21 rotating in the rotation direction R3 exerts a downstream force directed in the rotation direction R3 to the slip ring 34 at the position in proximity to the exit of the fixing nip N, the restraint 36 supports the slip ring 34 by contacting the outer circumferential surface of the slip ring 34 against the downstream force, thus restricting movement of the slip ring 34 in the radial direction of the fixing belt 21. Accordingly, the restraint 36 reduces the gap S between the inner face 34*a* of the slip ring 34 and the outer circumferential surface of the holding portion 33*a* of the belt holder 33 depicted in FIG. 10.

Alternatively, the restraint 36 may be disposed opposite the slip ring 34 at an arbitrary position within a circumferential span of the fixing belt 21 spanning from a proximate position in proximity to a downstream end of the fixing nip N in the rotation direction R3 of the fixing belt 21, that is, the exit of the fixing nip N, to the opposite position E opposite the fixing nip N in the rotation direction R3 of the fixing belt 21. The position of the restraint 36 is not limited to the positions shown in FIGS. 22 and 23 and is changed according to the direction in which the slip ring 34 moves in accordance with rotation of the fixing belt 21.

As described above, a restraint (e.g., the restraints 36, 36S, and 36T) restricts movement or displacement of the slip ring 34 in the radial direction of the fixing belt 21 and prevents creation of the gap S between the slip ring 34 and the belt holder 33 where the lateral end of the fixing belt 21 in the axial direction thereof may enter accidentally. In other words, the restraint restricts movement or displacement of the slip ring 34 in the radial direction of the fixing belt 21 so that the slip ring 34 does not deviate from the trajectory of the lateral end of the fixing belt 21 rotating in the rotation direction R3 thereof. Accordingly, the restraint prevents noise that may generate as the lateral end of the fixing belt 21 in the axial direction thereof slides over the inner edge of the slip ring 34 and breakage such as crack of the lateral end of the fixing belt 21 in the axial direction thereof, attaining the fixing devices 9, 9S, and 9T and the image forming apparatus 100 that form a high quality toner image on a sheet P and achieve an extended life.

A description is provided of advantages of the fixing devices 9, 9S, and 9T depicted in FIGS. 2, 3, and 4, respectively.

The fixing devices 9, 9S, and 9T include the endless fixing belt 21 serving as an endless belt or a fixing rotator rotatable in the rotation direction R3; the heater 25 disposed opposite the fixing belt 21 to heat the fixing belt 21; the pressure roller 22 serving as an opposed rotator contacting the outer circumferential surface of the fixing belt 21; the nip formation pad 26 disposed opposite the inner circumferential surface of the fixing belt 21 to press against the pressure roller 22 via the fixing belt 21 to form the fixing nip N between the fixing belt 21 and the pressure roller 22; the belt holder 33 contacting the lateral end of the fixing belt 21 in the axial direction thereof to rotatably support the fixing belt 21; the slip ring 34 serving as a ring interposed between the belt holder 33 and the lateral end of the fixing belt 21; and a restraint (e.g., the restraints 36, 36S, and 36T) disposed opposite the slip ring 34 to contact the slip ring 34. The restraint restricts movement or displacement of the slip ring 34 in the radial direction of the fixing belt 21 so as to prevent the slip ring 34 from deviating from the trajectory of the lateral end of the fixing belt 21 rotating in the rotation direction R3. That is, the restraint retains the slip ring 34 on the trajectory of the lateral end of the rotating fixing belt 21.

Accordingly, the restraint prevents noise that may generate as the lateral end of the fixing belt 21 in the axial direction thereof slides over the inner edge of the slip ring 34 and breakage such as crack of the lateral end of the fixing belt 21 in the axial direction thereof.

According to the exemplary embodiments described above, the fixing belt 21 serves as an endless belt or a fixing rotator. Alternatively, a fixing film, a fixing sleeve, or the like may be used as an endless belt or a fixing rotator. Further, the pressure roller 22 serves as an opposed rotator. Alternatively, a pressure belt or the like may be used as an opposed rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt rotatable in a predetermined direction of rotation;

an opposed rotator contacting an outer circumferential surface of the endless belt;

a nip formation pad, disposed opposite an inner circumferential surface of the endless belt, to press against the opposed rotator via the endless belt to form a fixing nip between the endless belt and the opposed rotator, the fixing nip through which a recording medium is conveyed;

a belt holder to contact and rotatably support a lateral end of the endless belt in an axial direction thereof;

a ring interposed between the belt holder and a lateral edge face of the endless belt; and a restraint, disposed opposite the ring, to contact the ring to restrict movement of the ring in a radial direction of the endless belt within a trajectory of the lateral end of the rotating endless belt, wherein the restraint includes an arcuate restraint face that is bulged towards an inner face of the ring.

2. The fixing device according to claim 1, wherein the restraint is disposed opposite the inner face of the ring.

3. The fixing device according to claim 2, wherein the belt holder includes a substantially tubular, holding portion disposed opposite the inner circumferential surface of the endless belt at the lateral end thereof and the inner face of the ring, the holding portion including a slit disposed opposite a first circumferential span of the endless belt corresponding to the fixing nip.

4. The fixing device according to claim 3, wherein the restraint is at the slit of the holding portion of the belt holder.

5. The fixing device according to claim 3, wherein the belt holder further includes a flange mounting the restraint and the restraint projects from the flange in the axial direction of the endless belt.

6. The fixing device according to claim 5, wherein a first length of the restraint in the axial direction of the endless belt is not greater than a second length of the holding portion of the belt holder in the axial direction of the endless belt.

7. The fixing device according to claim 3, wherein the belt holder further includes a groove, disposed in the holding portion, to engage the ring.

8. The fixing device according to claim 3, wherein:

the arcuate restraint face of the restraint is bulged towards the inner circumferential surface of the endless belt; and the restraint further includes:

an outboard end disposed opposite the inner face of the ring; and an inboard end disposed inboard from the outboard end in the axial direction of the endless belt.

9. The fixing device according to claim 8, wherein a bulge amount of the restraint face of the restraint decreases gradually from the outboard end to the inboard end of the restraint.

10. The fixing device according to claim 9, wherein:

the nip formation pad includes a nip formation face contacting the inner circumferential surface of the endless belt, and a ridge line of the restraint face of the restraint is blended into a hypothetical extension of the nip formation face of the nip formation pad.

11. The fixing device according to claim 8, wherein:

a radius of the restraint face of the restraint is even from the outboard end to the inboard end, and an arch length of the restraint face of the restraint in a recording medium conveyance direction decreases gradually from the outboard end to the inboard end of the restraint.

12. The fixing device according to claim 1, wherein the restraint is mounted on the belt holder.

13. The fixing device according to claim 1, wherein the restraint adjoins the nip formation pad.

14. The fixing device according to claim 1, wherein the restraint is disposed opposite an outer circumferential surface of the ring.

15. The fixing device according to claim 14, wherein the restraint is disposed opposite the ring at a position within a second circumferential span of the endless belt spanning from a proximate position in proximity to a downstream end of the fixing nip in the direction of rotation of the endless belt to an opposite position opposite the fixing nip.

16. The fixing device according to claim 1, wherein the trajectory of the endless belt is not circular.

17. The fixing device according to claim 1, wherein the opposed rotator includes a pressure roller.

18. An image forming apparatus comprising:

an image forming device to form a toner image; and a fixing device, disposed downstream from the image forming device in a recording medium conveyance direction, to fix the toner image on a recording medium, the fixing device including:

an endless belt rotatable in a predetermined direction of rotation;

an opposed rotator contacting an outer circumferential surface of the endless belt;

a nip formation pad, disposed opposite an inner circumferential surface of the endless belt, to press against the opposed rotator via the endless belt to form a fixing nip between the endless belt and the opposed rotator, the fixing nip through which a recording medium is conveyed;

a belt holder to contact and rotatably support a lateral end of the endless belt in an axial direction thereof;

a ring interposed between the belt holder and a lateral edge face of the endless belt; and a restraint, disposed opposite the ring, to contact the ring to restrict movement of the ring in a radial direction of the endless belt within a trajectory of the lateral end of the rotating endless belt, wherein the restraint includes an arcuate restraint face that is bulged towards an inner face of the ring.

19. A fixing device comprising:

an endless belt;

an opposed rotator contacting an outer circumferential surface of the endless belt;

a belt holder to contact and rotatably support a lateral end of the endless belt in an axial direction thereof;

a ring interposed between the belt holder and a lateral edge face of the endless belt; and a restraint, disposed opposite the ring, to contact the ring to restrict movement of the ring in a radial direction of the endless belt, wherein the restraint includes an arcuate restraint face bulged toward an inner face of the ring.

20. The fixing device according to claim 19, wherein the restraint is disposed opposite the inner face of the ring.

* * * * *